United States Patent [19]

Karay

[11] 4,065,180

[45] Dec. 27, 1977

[54] LEG-RESTRAINING DEVICE FOR GERIATRIC CHAIR

[76] Inventor: John Karay, 1408 College St., Bowling Green, Ky. 42101

[21] Appl. No.: 756,955

[22] Filed: Jan. 5, 1977

[51] Int. Cl.[2] ..... A47C 31/00

[52] U.S. Cl. ..... 297/384; 297/4; 297/DIG. 4

[58] Field of Search ..... 297/429, 430, 423, 390, 297/384, DIG. 4, DIG. 10

[56] References Cited

U.S. PATENT DOCUMENTS

| | | | |
|---|---|---|---|
| 2,649,139 | 8/1953 | Singleton | 297/429 |
| 3,669,493 | 6/1972 | Vowels | 297/429 |
| 3,761,129 | 9/1973 | Schultz | 297/429 |

FOREIGN PATENT DOCUMENTS

| | | | |
|---|---|---|---|
| 1,133,517 | 7/1962 | Germany | 297/429 |

*Primary Examiner*—James T. McCall
*Attorney, Agent, or Firm*—Harrington A. Lackey

[57] ABSTRACT

A leg-restraining device for a geriatric chair including a transversely disposed leg-restraining member supported in front of and below the front edge of the seat member of a geriatric chair in such a manner that the restraining member will lie closely adjacent to, but in front of, the shins of a patient seated in the geriatric chair, to prevent the patient from sliding forward off the chair.

5 Claims, 6 Drawing Figures

LEG-RESTRAINING DEVICE FOR GERIATRIC CHAIR

BACKGROUND OF THE INVENTION

This invention relates to a geriatric chair, and more particularly to a leg-restraining device for a geriatric chair.

Wheel chairs for geriatric patients and invalids are designed to render the patients as comfortable as possible, while facilitating mobility of the patient, when necessary.

However, difficulty has been experienced in preventing certain types of invalid or geriatric patients who are too weak or incapable of supporting themselves for any length of time in a sitting position within the wheel chair or geriateric chair. For such patients, there is a tendency for the patient to slip, or slide, down and forward until the patient has slipped or fallen completely off the chair.

Various types of restraining devices have been employed, but such restraining devices are designed to extend transversely of the chair over the upper torso, or over the lap area, of the patient. Such restraining devices are generally unsuccessful because the patients slip forward, down and beneath such restraining members, due to the lack of strenght or muscle control within the legs of the patient. Such torso and lap restraining devices provide no barrier agaist forward movement of the legs.

SUMMARY OF THE INVENTION

It is therefore an object of this invention to provide a restraining device for a geriatric chair, designed to restrain the forward movement of the legs of the patient seated in the chair, and specifically to restrain the forward movement of the shins or the area of the legs below the knees.

More specifically, this invention contemplates a transversely disposed, leg-restraining member, to which is fixed an elongated support member, preferably adjustably or telescopingly received in guide means fixed to the side frame members of the chair. The guide and support means mount the transverse leg-restraining member in front of and below the front edge of the seat, so that the transversely disposed restraining member is spaced only slightly in front of the shins of the patient seated in the chair, and below the knees of the patient. Thus, any tendency of the patient to slip forward will be resisted when the forward movement of the shins engages the restraining member or plate, to prevent any further forward movement of the patient from his seat, and therefore prevent the patient from falling from his chair.

BRIEF DESCIRPTION OF THE DRAWINGS

DESCRIPTION OF THE PREFERRED EMBODIMENTS

Figures 1, 2, 3, 4, 5, 6:
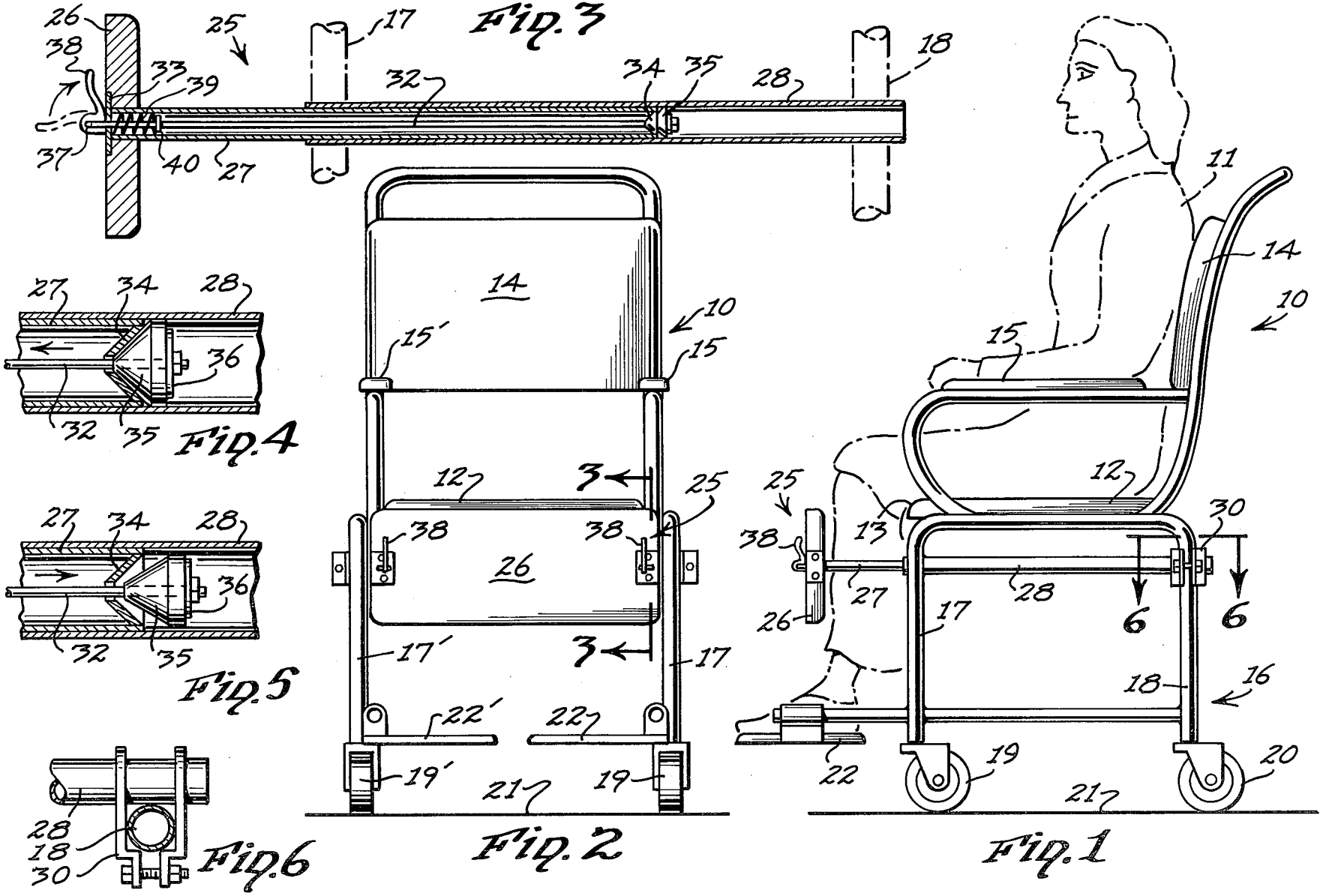
FIG. 1 is a side elevation of a geriatric chair in which a patient (in phantom) is seated, and upon which the restraining device, made in accordance with this invention, is mounted in operative position.
FIG. 2 is a front elevation of the chair disclosed in FIG. 1, without the patient.
FIG. 3 is an enlarged section taken along the line 3—3 of FIG. 2, disclosing the restraining device in solid lines mounted upon the frame of the geriatric chair disclosed in phantom.
FIG. 4 is an enlarged, fragmentary, sectional elevation of the telescoping support members, with the securing means in latched position.
FIG. 5 is an enlarged, fragmentary, sectional elevation similar to FIG. 4, but showing the securing means in unlatched position.
FIG. 6 is an enlarged, fragmentary section taken along the line 6—6 of FIG. 1.

Referring now to the drawings in more detail, FIGS. 1 and 2 disclose a typical geriatric chair 10 supporting a patient 11 (in phanton) in a seated position. The chair 10 is provided with a seat member 12 having a front edge 13, a back 14, and arm rests 15. The supporting frame 16 for the seat member 12 includes depending frame legs 17, 18 and 17' terminating in wheels or casters 19, 20 and 19', respectively, for supporting the chair 10 upon a floor surface 21.

The chair 10 may also be provided with the conventional, foldable foot-rests 22 and 22'.

The leg-restraining device 25, made in accordance with this invention includes an elongated, transversely extending, leg-restraining member or plate 26.

Fixed to each end portion of the leg-restraining member 26 and projecting rearward therefrom is an elongated support member 27. The particular elongated member 27 disclosed in the drawings is a straight, hollow tubular shaft, which is telescopingly received in a slightly larger, elongated tubular guide member 28, fixed in a substantially horizontal, front-to-rear attitude upon the front and rear legs 17 and 18 on the left side and the corresponding leg 17' and the rear leg, not shown, on the right side of the chair 10.

The tubular guide member 28 may be fixed to the legs 17 and 18 rigidly, by welding, or any other fixed securing means, such as illustrated in connection with the front leg 17. The tubular guide member 28 might also be fixed to both legs 17 and 18 for vertical adjustment by means of an adjustable clamp member 30, disclosed mounted only upon the rear leg 18, in FIG. 1. Of course, if clamps 30 were used, they would be used on all the legs 17, 18, 17' and the rear leg on the right side corresponding to leg 18, not shown, so that both tubular guide members 28 could be vertically adjusted.

The elongated support members 27 are longitudinally adjustable within the corresponding tubular guide member 28, so that the restraining member 26 can be adjusted at various spaced positions in front of, and generally below, the front edge 13 of the seat member 12. Such adjustment accommodates the legs of the patient 11 in a comfortable manner, and without the restraining member 26 touching the legs, unless the patient 11 starts to slip forward in the chair 10.

The elongated support members 27 may be secured in the various longitudinal adjustable positions relative to the tubular guide member 28 by any convenient latching or securing means. In the preferred form of the securing means, an elongated operator rod 32 extends coaxially within the hollow support member 27, and is longitudinally movable relative to the support member 27 within the front and rear bearings 33 and 34. Supported loosely upon the rear end portion of the rod 32 behind the rear frusto-conical bearing 34 is a flexible, frusto-conical wedge member 34, made of a soft plastic, or rubber. Fixed to the rear end of the rod 32 is an expander plate 36, which when urged forward to squeeze the wedge-shaped member 35 against the rear frusto-conical bearing 34, causes the wedge member 35 to expand radially, as disclosed in FIG. 4, to grip and wedge the support member 27 securely in fixed position within and against the inner wall of the tubular guide member 28.

The operator rod 32 is pivotally connected to a lever handle 38 about the pivot connection 37. When handle 38 is swung rearward in the direction of the arrow in FIG. 3, the operator rod 32 moves the expander plate 36 forward to squeeze the flexible wedge member 35 against the conical bearing 34, thereby expanding the wedge member 35, as disclosed in FIG. 4. However, when the lever handle 38 is released, the coil spring 39, acting against the keeper 40 fixed on the rod 32, urges the rod 32 rearward permitting the wedge member 35 to contract to its inoperative position disclosed in FIG. 5.

In operation, the lever handles 38 would be pulled to their inoperative positions to release the wedge members 35 from locking the tubular guide members 28, disclosed in FIG. 5. The leg-restraining member 26 could then be pulled forward, removing the elongated support memebers 27 entirely from the tubular guide members 28. Then the patient 11 could be assisted to a seated position upon the seat 12 within the chair 10, with the patient's feet upon the foot rest members 22 and 22'. The support members 27 are then re-introduced into and slidably moved rearwardly within, the tubular guide members 28 until the leg-restraining member 26 is in the desired position relative to the legs of the patient 11. At this time, the lever handles 28 are pushed rearward to pull the operator rods 32 forward thereby expanding the wedge members 35 into locking engagement with the inner walls of the tubular guide members 28. The handles 38 may then be latched in their operative wedging position in any desired manner, such as by the desired off-center construction of the handles 38 as disclosed in the drawings and particularly in FIG. 3.

Should the patient 11, because of his or her weakened condition, or lack of adequate muscle control, tend to slip forward in the chair 10, the patient's shins will bear against the rigid leg-restraining member 26 to block any further slipping of the patient, and to hold the patient 11 in the seated position within the chair 10.

What is claimed is:

1. In a chair including a generally planar seat member having a front edge and opposite sides, and a frame member supporting the seat member above and substantially parallel to a floor surface, a leg-restraining device comprising:

a. an elongated, generally planar, leg-restraining member having opposite end portions, b. two elongated support members, each support member being attached to one of the opposite end portions of said leg-restraining member, c. means mounting each of said support members to the frame member on opposite sides of said seat member to dispose the plane of said restraining member normal to the plane of said seat member, and spaced in front of, slightly below, and parallel to the front edge of said seat member, d. said leg-restraining member being normally spaced proximate to and in front of the shins of the person seated upon the seat member of the chair with his legs depending over the front edge of the seat member, said leg-restraining member being positioned to block the movement of the shins of a person sliding forwardly from his seat-supported position on said seat member, and e. means operatively connected to said support member for removing said leg-restraining member from said frame member and for adjusting the position of said restraining member toward and away from said frame member below said seat member.

2. The invention according to claim 1 in which said mounting means comprises guide means on said frame member for receiving said elongated support members for relative longitudinal movement.

3. The invention according to claim 2 further comprising means for securing each of said support members in said guide means in an adjusted fixed position relative to said frame member.

4. The invention according to claim 3 in which said guide means comprises a pair of tubular guide members fixed to opposite sides of said frame member and telescopingly receiving the corresponding elongated support members.

5. The invention according to claim 4 in which said securing means comprises and expansible wedge member on each of said support members, an operator member operatively connected to each of said wedge members for expanding said corresponding wedge member into gripping engagement with a corresponding tubular guide member.

* * * * *